United States Patent [19]

Miyagawa et al.

[11] Patent Number: 4,665,893

[45] Date of Patent: May 19, 1987

[54] KITCHEN UNIT COOKING STOVE HAVING INTERNAL COOLING SYSTEM

[75] Inventors: Junichi Miyagawa; Tetuo Kamo; Kazuichi Okada, all of Osaka, Japan

[73] Assignee: Matsushita Electric Industrial Co., Ltd., Japan

[21] Appl. No.: 792,047

[22] Filed: Oct. 28, 1985

[30] Foreign Application Priority Data

Oct. 29, 1984 [JP] Japan ..... 59-227101

[51] Int. Cl.[4] ..... F24C 15/20

[52] U.S. Cl. ..... 126/299 D; 126/21 R; 126/37 R; 126/39 BA; 126/39 K; 219/10.49 R; 219/10.67

[58] Field of Search ..... 126/299 R, 299 D, 21 R, 126/21 A, 39 BA, 37 R, 198, 39 K, 307 R, 303; 219/402, 413, 414, 400, 10.67, 10.49 R; 99/340

[56] References Cited

U.S. PATENT DOCUMENTS

| | | | |
|---|---|---|---|
| 3,131,688 | 5/1964 | Lipstein | 126/299 R |
| 3,589,266 | 6/1971 | Hike | 126/299 D |
| 3,596,650 | 8/1971 | Cerola | 126/37 R |
| 3,712,819 | 1/1973 | Field | 126/299 R |
| 4,431,892 | 2/1984 | White | 126/299 D |
| 4,490,596 | 12/1984 | Hirai et al. | 126/21 A |
| 4,551,600 | 11/1985 | Miyagawa et al. | 126/299 D |

*Primary Examiner*—Samuel Scott
*Assistant Examiner*—H. A. Odar
*Attorney, Agent, or Firm*—Lowe, Price, LeBlanc, Becker & Shur

[57] ABSTRACT

A cooking stove such as an induction heating cooking stove which is fitted into an aperture on top of a kitchen unit has one or more independent heater units mounted within an outer case, below a top plate which cooking pans, etc can be heated. Each heater unit consists of an open-ended box-shaped internal chassis having one or more heater elements mounted on a top face thereof and an aperture formed in a bottom face thereof. Each internal chassis is provided with a motor-driven cooling fan which acts to produce a flow of cooling air through the interior of the chassis and out through the lower aperture into a ventilation duct, and hence to the atmosphere via a cooling air inlet/outlet section which can be conveniently provided at the upper rear part of the top of the stove. No additional ventilation apertures need be provided in the kitchen unit, and the number of heater elements can be readily varied as required, while the overall design is extremely simple and readily manufactured.

3 Claims, 8 Drawing Figures

KITCHEN UNIT COOKING STOVE HAVING INTERNAL COOLING SYSTEM

BACKGROUND OF THE INVENTION

The present invention relates to a cooking stove which is removably mounted within an opening cut in a table top board forming part of a kitchen unit, and in particular to a cooking stove of this type which employs high-frequency induction heating.

In the prior art, such a cooking stove generally has two or more heater elements, e.g. with each heater element including an induction heating coil. In order to prevent excessive internal temperature rise within the interior of the cooking stove, comparatively complex internal cooling arrangements are necessary in order to remove heat which is dissipated by the heating elements. Since the positions of components of the internal cooling system are fixed, it is difficult to vary the positions of the heater elements, and it is necessary to provide large ventilation apertures in the cooking stove and in the kitchen unit itself, in order to ensure a sufficiently high cooling capacity. In addition, also due to the fact that the positions of the components of the cooling system are fixed, it is difficult to increase the number of heater elements in a simple manner.

SUMMARY OF THE INVENTION

It is an objective of the present invention to provide a cooking stove having two or more heater elements, having a simple internal configuration, which is capable of being produced at low cost, employs a very simple internal cooling system, and which can be mounted in a removable, closely fitting manner in a kitchen unit without the need for providing ventilation apertures or ducts, etc, in the kitchen unit itself.

A cooking stove according to the present invention consists of heater units which are contained in the interior of the cooking stove, each heater unit consisting of an independent internal chassis having a box-shaped configuration with one or more heater elements mounted on the top face of each internal chassis. At least one aperture is provided in the vertically oriented side faces of each internal chassis, and a lower aperture is formed in the base of the chassis. Each of the internal chassis is provided with a cooling fan, disposed to draw air from the side apertures of the chassis, through the interior of the chassis, and out through the lower aperture in the chassis into a cooling duct disposed below that lower aperture. The heater units are arranged in a successively adjacent manner, and due to the fact that each heater unit and the internal cooling of each chassis operates in an independent manner, the number of heater elements of such a cooking stove can be readily increased as required for installation in different types of kitchen unit. The inlet air for cooling the chassis and the outlet air from the cooling ducts pass through a cooling air inlet/outlet section formed at a convenient position in the cooking stove itself, e.g. at the top of the rear of the stove, so that it is not necessary to form other ventilation apertures in the side walls of the case of the cooking stove or in the kitchen unit, to ensure sufficient cooling.

In the case of a cooking stove employing high-frequency induction heating, the electronic components which drive each of the heater elements can be conveniently mounted in the interior of the corresponding internal chassis, and effectively cooled by the flow of air through the chassis interior.

With such a cooling system, the internal configuration of the cooking stove can be made extremely simple and inexpensive to manufacture.

DETAILED DESCRIPTION OF THE EMBODIMENTS

Figure 1:
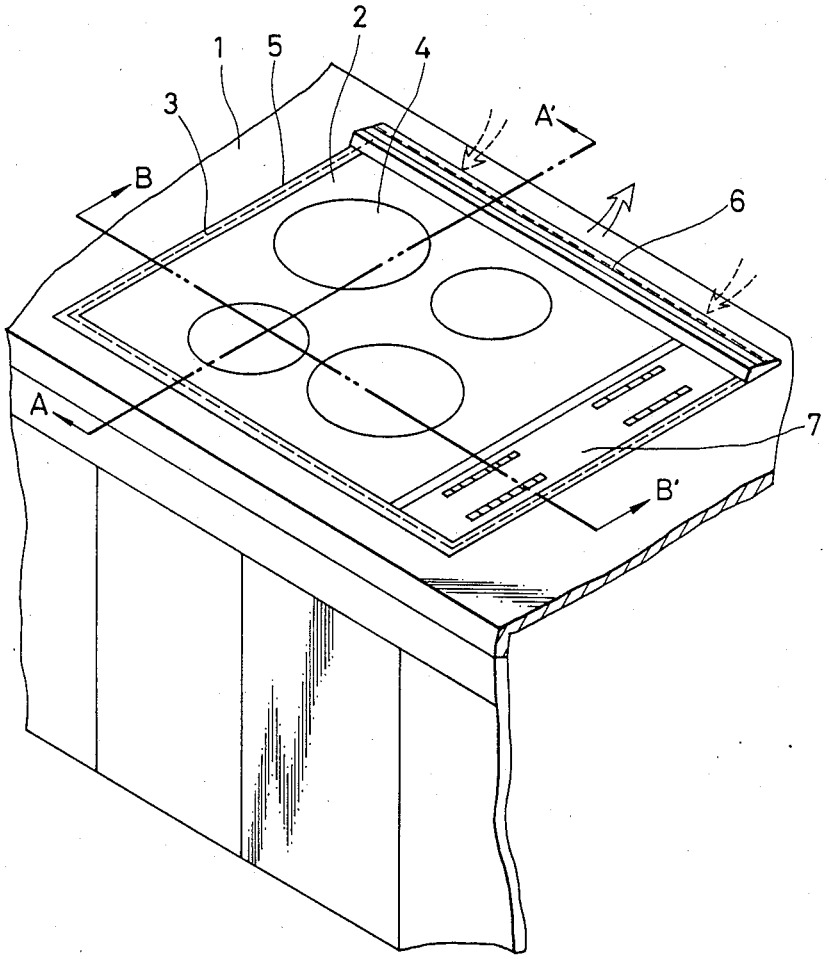
FIG. 1 is an oblique view of an embodiment of a cooking stove according to the present invention which is fitted into a table top board of a kitchen unit.

Referring to FIG. 1, reference numeral 1 denotes a top member of a kitchen unit, having a flat upper surface which can be utilized for example as a drainboard or for cooking operations. This top member of the kitchen unit will be referred to in the following as a table top board. Reference numeral 2 denotes an embodiment of a cooking stove according to the present invention, which is removably fitted into an opening 3 formed in the table top board 1. Numeral 4 denotes a top plate of cooking stove 2, having an upper surface which serves as a cooking surface and which is supported by a frame 5. Reference numeral 6 denotes a back grill which is positioned at the rear of the top plate 4 and which has ventilation air inlet and outlet apertures formed therein as described hereinafter, which are utilized to pass a flow of cooling air through the interior of cooking stove 2. Numeral 7 denotes a control panel, by which the user can adjust the level of electrical power supplied to each of the heater elements of the stove, and is preferably of touch-switch type.

Figure 2:
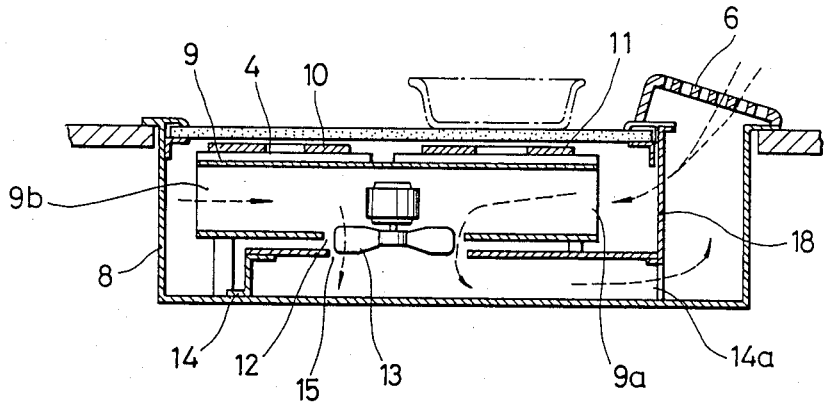
FIG. 2 is a cross-sectional view taken along line A—A′ in FIG. 1.
Figure 3:
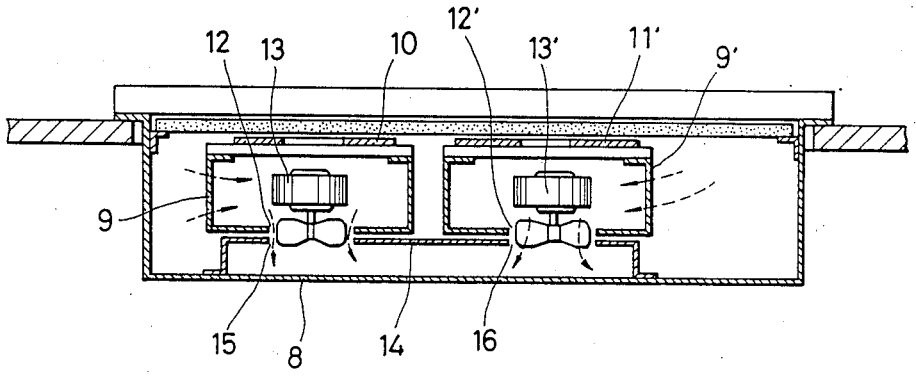
FIG. 3 is a cross-sectional view taken along line B—B′ in FIG. 1.
Figure 4:
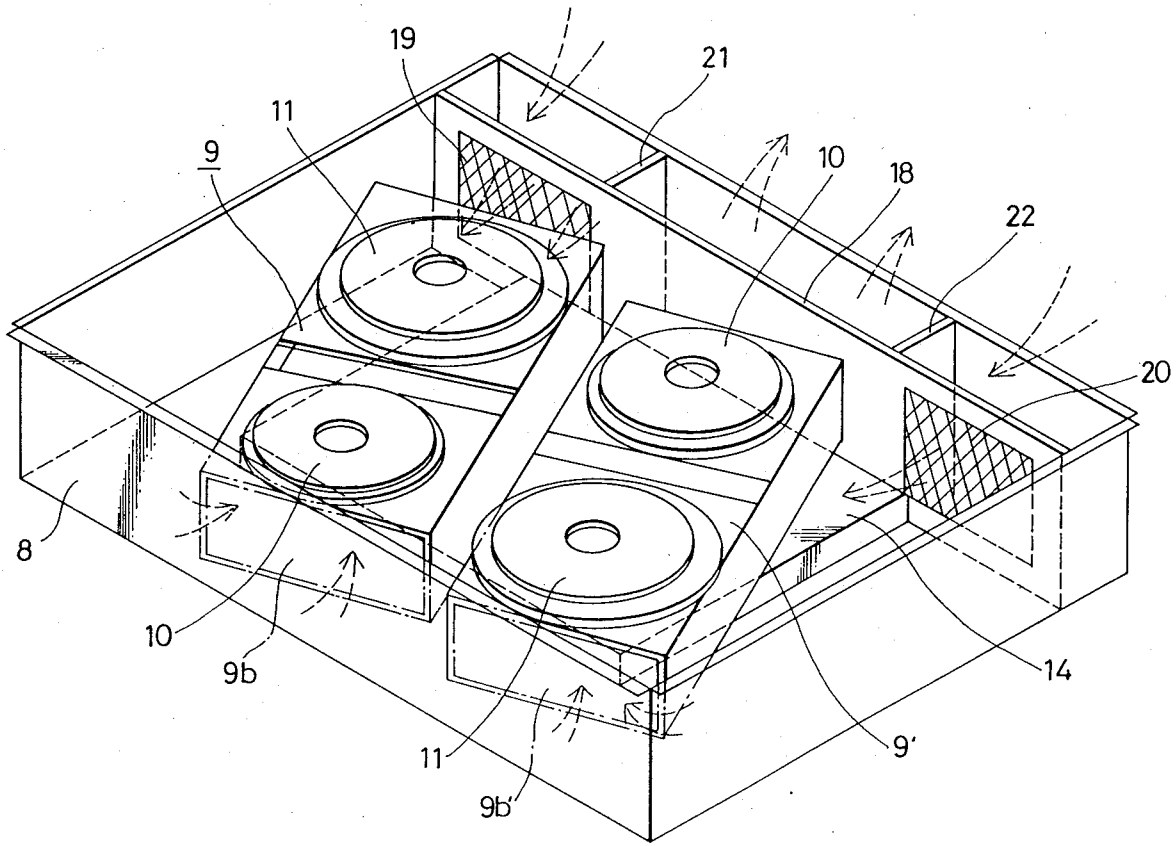
FIG. 4 is an oblique view of the interior of a cooking stove.
Figure 5:
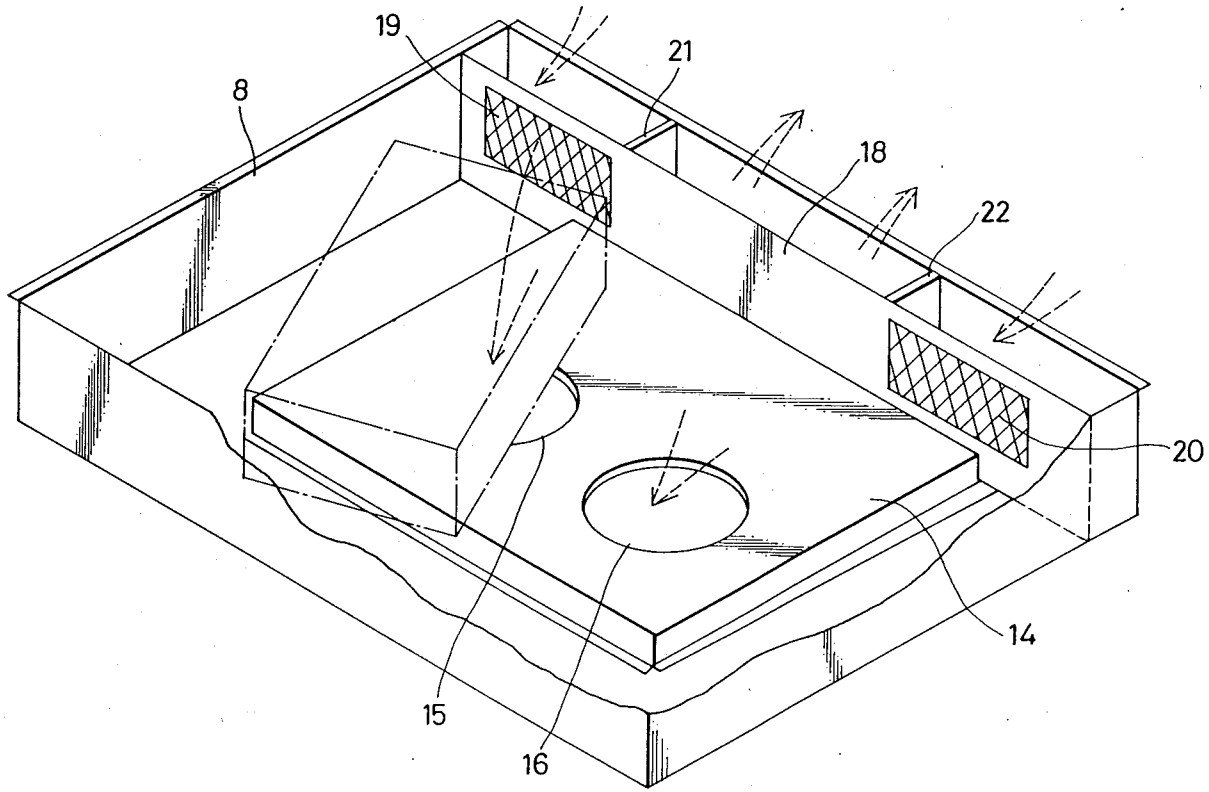
FIG. 5 is an oblique view to illustrate the configuration of the ventilation ducts.

FIG. 2 is a cross-sectional view taken along line A—A′ in FIG. 1, and FIG. 3 is a cross-sectional view taken along line B—B′, while FIG. 4 is an oblique view of the interior of cooking stove 2. In FIGS. 2, 3 and 4, reference numeral 8 denotes the case of cooking stove 2, and reference numeral 9 denotes a first internal chassis on top of which are mounted heater elements 10 and 11, while a second internal chassis 9′, of identical configuration to first internal chassis 9, has heater elements 10′ and 11′ mounted thereon. In this embodiment, heater elements 10 and 11 employ high-frequency induction heating coils. Each of the internal chassis 9 and 9′ is formed from sheet material and is shaped to be of hollow rectangular cross-section, leaving two open opposing sides, e.g. as designated by **9*a* and 9*b*, through which air can flow into the chassis interior. An aperture 12 is formed in the center of the base of the internal chassis 9, while a motor-driven cooling fan 13 is mounted in aperture 12 such as to produce a flow of cooling air therethrough, directed downward. Internal chassis 9′ is similarly provided with a cooling fan 13', and lower aperture 12'. Numeral 6 denotes a back grill, through which cooling air passes into and out from the internal cooling system of cooking stove 2. Numeral 14 denotes a ventilation duct member having the shape of an inverted tray which has an open rear side, denoted as 14***a*, and which is mounted on the upper surface of the base of case 8. Circular apertures 15 and 16 are formed in the top of the ventilation duct member 14, positioned to receive cooling air flows from fans 13 and 13' respectively. Reference numeral 18 denotes a partitioning plate which is disposed at the rear of the case 8, and which serves to ensure that the exhaust air flowing through the ventilation duct member 14 will not be recirculated within the internal chassis 9 and 9', but will flow out through the back grill 6. Reference numerals 19 and 20 denote apertures which are formed in the partitioning plate 18, through which cooling air flows inward. Numerals 21 and 22 denote separation plates which serve to separate the air inlet and air outlet sections of back grill 6.

A cooling air inlet/outlet section is thereby constituted by partitioning plate 18 with apertures 19, 20 formed therein, separation plates 21, 22 and the rear side of case 8. All of the air flow which performs cooling of the interior of cooking stove 2 passes inward and outward through this cooling air inlet/outlet section, so that it is unnecessary to form any ventilation apertures in the kitchen unit containing cooking stove 2 for cooling purposes, or any additional ventilation apertures in case 8.

Figure 6:
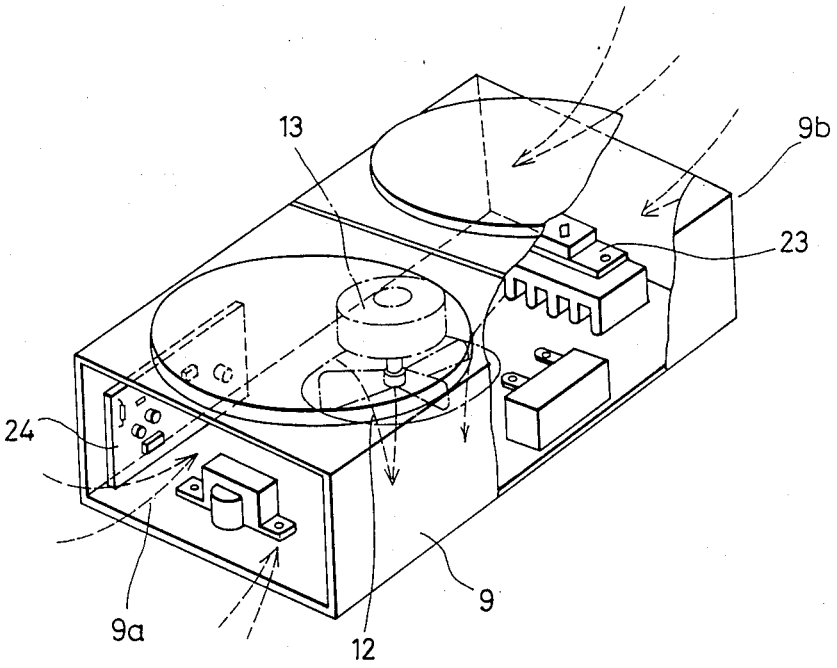
FIG. 6 is an oblique view to show the configuration of an internal chassis.

FIG. 6 shows the interior of internal chassis 9 in greater detail, with the interior of internal chassis 9' being of course identical thereto. In FIG. 6, numeral 23 denotes a heat dissipating power transistor, forming part of an electronic circuit which drives high-frequency induction heating elements 10 and 11. Reference numeral 24 denotes a circuit board on which are mounted other electronic components to control operation of the heater elements 9, 11. As shown in FIG. 6, as a result of rotation of the cooling fans 13 of internal chassis 9, cooling air will flow through both of the side openings 9*a*, 9*b* into the interior of the chassis. After cooling the power transistor 23 and circuit board 24 this air flows out through the lower aperture 12.

The overall operation of the cooling system of this embodiment will now be described, referring to FIGS. 2, 3 and 4. When electrical power is supplied to any of the heater elements 10, 11, 10', 11' of the cooking stove 2, one or both of cooling fans 13 and 13' of internal chassis 9 and 9' will be set in operation. Cooling air will thereby flow through ventilation paths which include the interiors of internal chassis 9 and 9', i.e. air from the external atmosphere will be drawn into the inlet apertures 19 and 20 formed in partitioning plate 18, from the inlet sections of back grill 6, will then flow through the side apertures 9*a*, 9*b*, 9'*a*, 9'*b* of internal chassis 9 and 9', and then through the lower apertures 12, 12' in these chassis past cooling fans 13, 13'. The air will then flow through ventilation duct 14 to be output through back grill 6. Due to this flow of cooling air, circuit components within the internal chassis 9 and 9' are cooled to a sufficient degree to ensure that the components will be maintained below a specific temperature. Also, due to the fact that each of the internal chassis 9, 9' has a "tunnel" configuration, i.e. is of hollow shape with a rectangular cross-section and openings at side faces thereof, the flow of ventilating air will be concentrated upon specific components which must be effectively cooled. Cooling of the internal components within the chassis 9 and 9' is thereby executed in a highly efficient manner.

With the embodiment of the present invention described hereinabove, independent cooling fans are provided for each of the internal chassis, so that highly effective cooling is attained. In addition, although only two internal chassis 9 and 9' are incorporated in the described embodiment it will be apparent that the number of internal chassis, and hence the number of heater elements, can be easily increased as required. This is due to the fact that the internal chassis are each of identical configuration and are arrayed successively adjacent to one another. Furthermore it will be apparent that it is not necessary to form any apertures in the kitchen unit which accommodates the cooking stove, other than the opening 3 into which the cooking stove 2 is fitted. Thus, no machining of the kitchen unit is necessary, to provide for cooling of the cooking stove, so that installation of such a stove and the design of a kitchen unit to accommodate the stove are made extremely simple.

As shown in FIG. 4, the internal chassis 9 and 9' of the described embodiment each are provided with two heater elements which differ in size, i.e. a small heater element 10 (10')and a large heater element 11 (11'), with the large and small heater elements being positioned in an angularly opposing relationship as shown in FIG. 4. Such an arrangement serves to facilitate the positioning of cooking pans upon the top plate, and can be easily implemented with the described embodiment.

Figure 7:
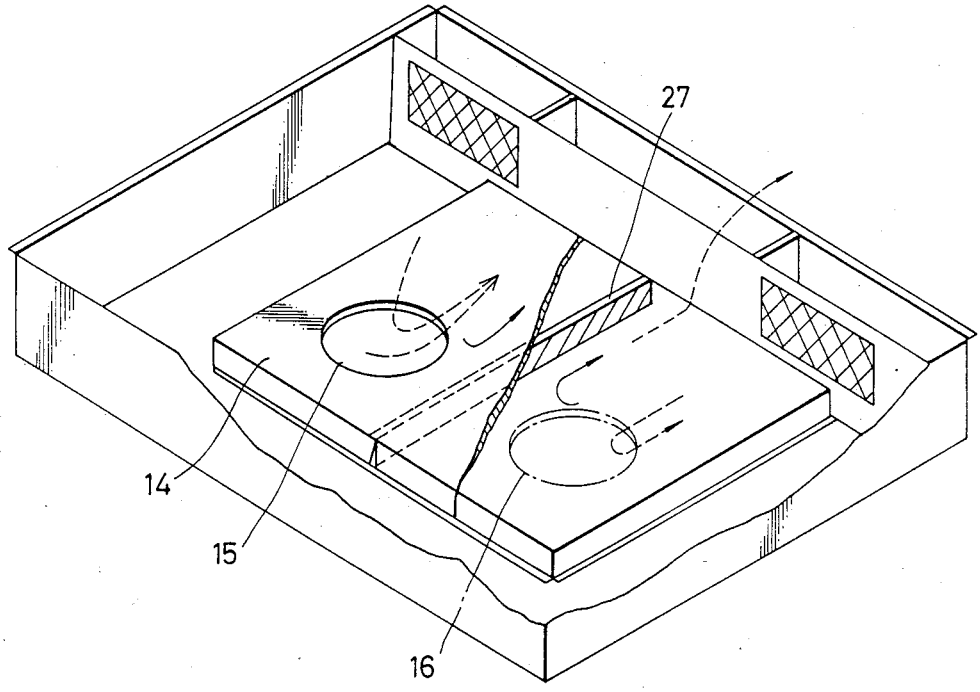
FIG. 7 is an oblique view to show partitioning of the ventilation ducts.
Figure 8:
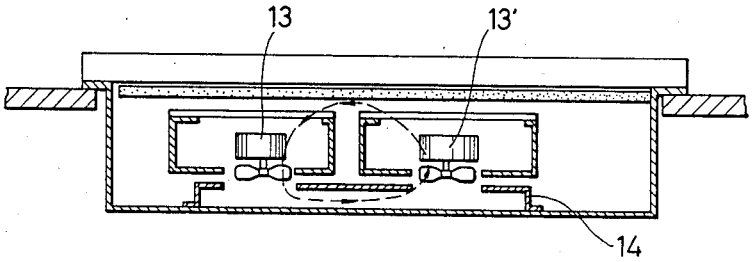
FIG. 8 is a cross-sectional view to show a "short-circuit" air flow condition of the internal chassis ventilation system.

Furthermore, as shown in FIG. 7, a partitioning plate 27 is mounted in the interior of the ventilation duct, in order to separate the ventilation air flows of the first internal chassis 9 and the second internal chassis 9'. In this way, in the event that only one of the cooling fans is set in operation, a "short-circuit" air flow bypass effect will be prevented. If partitioning plate 27 were not incorporated, a condition could occur in which air is continuously recirculated within the interior of the cooking stove as illustrated in FIG. 8, thereby causing a rise in the internal temperature of the cooking stove. The partitioning plate 27 thus serves to enhance the effectiveness of the ventilation system.

As described in the above, with a configuration for a cooking stove according to the present invention, it is unnecessary to provide ventilation apertures in the exterior walls of the case of the cooking stove or in the kitchen unit within which the cooking stove is fitted. In addition, a plurality of heater elements can be easily provided within the cooking stove. Due to the use of separate internal chassis, each provided with an independent cooling fan and ventilation path, it is not necessary for any special consideration to be given to cooling of the cooking stove, when the stove is to be installed within a kitchen unit. Furthermore the design of a cooking stove according to the present invention is such that the number of heater elements can be easily increased. In addition, due to the use of independent heater units, assembly at the time of manufacture and changeover of units during servicing can be very easily carried out. Thus the present invention enables an extremely simple and low-cost cooking stove to be manufactured.

Although the present invention has been described in the above with reference to a specific embodiment, it should be noted that various changes and modifications to the embodiments may be envisaged which fall within the scope claimed for the invention as set out in the appended claims. The above specification should therefore be interpreted in a descriptive and not in a limiting sense.

What is claimed is:

1. A cooking stove, comprising:

a case having a cooling air inlet/outlet section formed therein;

a top plate mounted on an upper part of said case, formed with a flat upper surface for use as a cooking surface;

a ventilation duct member mounted within said case, forming a vertilation duct communicating with said cooling air inlet/outlet section and having a ventilation aperture formed through an upper face thereof;

at least one internal chassis mounted within said case upon said ventilation duct member, each said chassis being formed independently of said case and ventilation duct member and having a hollow rectangular configuration with four sides and two substantially open opposing ends and having a chassis aperture formed through the lowest one of said sides thereof, said chassis aperture being positioned substantially centrally in said lowest side and communicating with said ventilation aperture in said upper face of said ventilation duct member; two heater elements mounted on the uppermost one of said sides of said internal chassis, with one of said two heater elements positioned adjacent each of said open opposing ends of said internal chassis and below said cooking surface of said top plate; and a motor-driven cooling fan mounted within each of said internal chassis adjacent said chassis aperture in said lowest side thereof, for drawing a flow of cooling air inward from said cooling air inlet/outlet section, through said opposing open ends and outward through said chassis aperture thereof into said ventilation duct.

2. A cooking stove, comprising:

a case having a cooling air inlet/outlet section formed therein;

a top plate mounted on an upper part of said case, formed with a flat upper surface for use as a cooking surface;

a ventilation duct member mounted within said case, forming a ventilation duct communicating with said cooling air inlet/outlet section and having a ventilation aperture formed through an upper face thereof;

two internal chassis mounted within said case upon said ventilation duct member, each said chassis being formed independently of said case and ventilation duct member and having a hollow rectangular configuration with four sides and two substantially open opposing ends and having a chassis aperture formed through the lowest one of said sides thereof, said chassis aperture being positioned substantially centrally in said lowest side and communicating with said ventilation aperture in said upper face of said ventilation duct member;

two heater elements mounted on the uppermost one of said sides of each of said internal chassis, with one of said two heater elements positioned ajdacent each of said open opposing ends of said internal chassis and below said cooking surface of said top plate; and a motor-driven cooling fan mounted within each of said internal chassis adjacent said chassis aperture in said lowest side thereof, for drawing a flow of cooling air inward from said cooling air inlet/outlet section, through said opposing open ends and outward through said chassis aperture thereof into said ventilation duct;

in which said heater elements of each of said internal chassis comprise one small heater element and one large heater element.

3. A cooking stove, comprising:

a case having a cooling air inlet/outlet section formed therein;

a top plate mounted on an upper part of said case, formed with a flat upper surface for use as a cooking surface;

a ventilation duct member mounted within said case, forming a ventilation duct communicating with said cooling air inlet/outlet section and having a ventilation aperture formed through an upper face thereof;

at lest two internal chassis mounted within said case upon said ventilation duct member, each said chassis being formed independently of said case and ventilation duct mcmber and having a hollow rectangular configuration with four sides and two substantially open opposing ends and having a chassis aperture formed through the lowest one of said sides thereof, said chassis aperture being positioned substantially centrally in said lowest side and communicating with said ventilation aperture in said upper face of said ventilation duct member;

two heater elements mounted on the uppermost one of said sides of each of said internal chassis, with one of said two heater elements positioned adjacent each of said open opposing epds of said internal chassis and below said cooking surface of said top plate; and a motor-driven cooling fan mounted within each of said internal chassis adjacent said chassis aperture in said lowest side thereof, for drawing a flow of cooling air inward from said cooling air inlet/outlet section, through said opposing open ends and outward through said chassis aperture thereof into said ventilation duct;

wherein said stove further comprises at least one partitioning member mounted in the interior of said ventilation duct member for separating flows of cooling air from respective ones of said two internal chassis communicating therewith.

* * * * *